US009413082B2

(12) United States Patent
Gassauer

(10) Patent No.: US 9,413,082 B2
(45) Date of Patent: Aug. 9, 2016

(54) SPRING FORCE TERMINAL CONNECTION AND ELECTRIC DEVICE THEREWITH

(71) Applicant: WAGO Verwaltungsgesellschaft mbH, Minden (DE)

(72) Inventor: Stephan Gassauer, Ilfeld (DE)

(73) Assignee: WAGO VERWALTUNGSGESELLSCHAFT MBH, Minden (DE)

( * ) Notice: Subject to any disclaimer, the term of this patent is extended or adjusted under 35 U.S.C. 154(b) by 0 days.

(21) Appl. No.: 14/441,756

(22) PCT Filed: Nov. 6, 2013

(86) PCT No.: PCT/EP2013/073135
§ 371 (c)(1),
(2) Date: May 8, 2015

(87) PCT Pub. No.: WO2014/072327
PCT Pub. Date: May 15, 2014

(65) Prior Publication Data

US 2015/0357727 A1 Dec. 10, 2015

(30) Foreign Application Priority Data

Nov. 9, 2012 (DE) ..... 10 2012 110 759

(51) Int. Cl.
*H01R 4/48* (2006.01)

(52) U.S. Cl.
CPC ..... *H01R 4/48* (2013.01); *H01R 4/4836* (2013.01); *H01R 4/4845* (2013.01)

(58) Field of Classification Search
CPC ..... H01R 4/48; H01R 4/4836; H01R 4/4845
USPC ..... 439/729, 751, 266, 358, 725
See application file for complete search history.

(56) References Cited

U.S. PATENT DOCUMENTS 6,689,955 B2 * 2/2004 Doutaz ..... H01R 4/4845 174/135
7,510,448 B2 * 3/2009 Eppe ..... H01R 4/4836 439/729

(Continued)

FOREIGN PATENT DOCUMENTS

DE 10 2008 052 626 4/2010
DE 10 2008 060 283 7/2010

(Continued)

OTHER PUBLICATIONS

International Search Report and translation thereof, for corresponding International application No. PCT/EP2013/073135 dated Feb. 7, 2014.

*Primary Examiner* — Abdullah Riyami
*Assistant Examiner* — Harshad Patel
(74) *Attorney, Agent, or Firm* — Renner, Otto, Boisselle & Sklar LLP.

(57) ABSTRACT

Disclosed is a spring force terminal connection (1) comprising a busbar (2), a terminal spring (4) in the form of a cage tensile spring, and an actuation element (13) which is displaceably mounted to act upon the actuation section (7) of the terminal spring (4) such that a terminal point can be opened and closed. A bearing arm (12, 22) extends from the direction of the busbar (2) through a slot (9, 20) in the terminal section (8) and/or in the actuation section (7) of the terminal spring (4). The section of the bearing arm (12, 22) that extends through the slot (9, 20) is arranged in a region between the lateral edges of the terminal spring (4) and supports the actuation element (13).

7 Claims, 16 Drawing Sheets

(56) References Cited

U.S. PATENT DOCUMENTS

| | | | | |
|---|---|---|---|---|
| 8,129,641 | B2 * | 3/2012 | Majewski | H01R 4/4845 200/335 |
| 8,475,191 | B2 * | 7/2013 | Schafmeister | H01R 4/4836 439/266 |
| 8,480,424 | B2 * | 7/2013 | Koellmann | H01R 4/4836 439/358 |
| 2007/0207662 | A1 | 9/2007 | Germani | |
| 2012/0077391 | A1 | 3/2012 | He et al. | |
| 2012/0238156 | A1 * | 9/2012 | Hayashi | H01R 4/4836 439/820 |

FOREIGN PATENT DOCUMENTS

| | | |
|---|---|---|
| EP | 1 213 791 | 6/2002 |
| WO | 2010/063728 | 6/2010 |

* cited by examiner

SPRING FORCE TERMINAL CONNECTION AND ELECTRIC DEVICE THEREWITH

This application is a national phase of International Application No. PCT/EP2013/073135 filed Jun. 6, 2013.

The invention relates to a spring force terminal connection comprising:

a busbar, a clamping spring, which has a resting section which is supported on the busbar, a spring bend, which adjoins the resting section, an actuating section, which adjoins the spring bend and is opposite the resting section, and a clamping section, which adjoins the actuating section and extends from the actuating section in the direction of the busbar, wherein the clamping section has a conductor leadthrough opening, and wherein the busbar is passed through the conductor leadthrough opening, and a clamping point for a conductor to be connected is provided between the busbar and a transverse web limiting the conductor leadthrough opening, and an actuating element, which is mounted movably for acting on the actuating section in such a way that the transverse web, which limits the conductor leadthrough opening and forms a clamping point, is movable away from the busbar in the case of a movement of the actuating element, for example by pivoting or a linear movement, into an open position.

The invention furthermore relates to an electrical device comprising an insulating housing and comprising at least one such spring force terminal connection in the insulating housing.

Spring force connection terminals are known in a variety of forms, for example from conductor connection terminals, terminal boxes, terminal blocks or installed in electrical devices, such as automation devices for industrial control or building automation, for example.

EP 1 213 791 B1 discloses an electrical connector comprising a cage strain spring comprising a self-supporting actuating lever. This actuating lever is mounted rotatably on a bent-back busbar section.

DE 10 2008 060 282 A1 discloses a spring terminal which can be actuated without the use of a tool for an electrical conductor, in which an actuating lever is suspended in a notch in the resting limb of a cage strain spring and is guided laterally past the cage strain spring with at least one side limb.

DE 10 2008 052 626 A1 describes a connection terminal comprising a bow engaging around a clamping spring on both sides, on which bow an actuating lever is articulated.

EP 2 001 086 B1 discloses a screwless connection terminal comprising a cage strain spring, in which an actuating lever is suspended in a bearing bend of a busbar behind the spring bend of the cage strain spring. The actuating lever engages around the busbar on both sides and rests on the actuating section of the cage strain spring.

Against this background, the object of the present invention consists in providing an improved spring force terminal connection comprising a self-supporting and compact actuation arrangement.

The object is achieved by the spring force terminal connection having the features of claim 1 and by the electrical device having the features of claim 7.

Advantageous embodiments are described in the dependent claims.

It is proposed for a spring force terminal connection comprising a cage strain spring that a bearing arm extends out of the direction of the busbar through a slot in the clamping section and/or in the actuating section and interacts with the actuating element for movably mounting the actuating element, wherein that section of the bearing arm which extends through the slot is arranged in a region between the side edges of the clamping spring and supports the actuating element.

It is therefore proposed not to guide a bearing arm laterally past the clamping spring, as has previously been conventional, but to pass the bearing arm through a slot in the clamping section and/or in the actuating section of the cage strain spring. In this case, the actuating element adjoins the bearing arm and, when actuated, rests on the actuating section of the clamping spring in order to exert an actuation force. Thus, a very compact and self-supporting actuating arrangement which has a closed force flow during pivoting of the actuating element is realized. The lever actuation forces in this case do not act on the housing in the steady state, and the actuation by the actuating element is largely independent of the insulating housing of the connection terminal. The splitting of the connection terminal in this case remains unaffected, so that the proposed solution enables a connection terminal with a narrow design, even when taking into consideration the required air gaps and leakage paths.

The width of the spring force terminal connection in the direction of division, i.e. transversely to the direction of extent of the busbar and the clamping section of the clamping spring, is in any case not enlarged by the actuating element.

The cage strain spring with the bearing arm arranged thereon and passed therethrough and comprising the actuating element can also be treated separately as one assembly and built into a device, which already provides a busbar.

The provision of a slot in the clamping section and/or in the actuating section for passing through the bearing arm has no disadvantageous effects on the strain distribution in the cage strain spring. This is determined critically by the spring bend, which remains unaffected.

It is particularly advantageous if the bearing arm is arranged centrally in the direction of the width of the clamping spring, i.e. the bearing arm is guided centrally transversely with respect to the direction of extent of the busbar and transversely with respect to the direction of extent of the clamping section and the resting section of the cage strain spring. The bearing arm is thus in the center, when viewed from the opposite side edges of the cage strain spring, and is arranged there preferably in the region of the clamping section. However, it is essential that the bearing arm is not guided laterally past the clamping spring, but is arranged at least partially in the space surrounded by the clamping spring.

In a preferred embodiment, the bearing arm is formed as an extension of the resting section integrally with the clamping spring. For this purpose, a spring steel sheet section is cut or punched out of the resting section and bent back in the direction of the actuating section away from the resting section and the busbar arranged therein.

The actuating element can then be mounted pivotably on the free end of the bearing arm. For this purpose, it is advantageous if the bearing arm has a pivot bearing at its end remote from the busbar and the actuating element is mounted pivotably in or on the pivot bearing.

In an alternative embodiment, however, it can also be mounted linearly movably on the exposed bearing arm. If appropriate, a further flap of material bent out of the clamping spring can be used for this purpose for further guidance.

However, it is also conceivable for a separate bearing arm to be arranged between the resting section of the clamping spring and the busbar. This bearing arm can be formed from a plastic material, for example. The bearing arm can be fixedly connected integrally to the actuating element and mounted pivotably or displaceably in the margin between the resting section of the clamping spring and the busbar.

However, it is particularly advantageous if the bearing arm has a pivot bearing at its end remote from the busbar, and the actuating element is mounted pivotably in this pivot bearing. The bearing arm and the actuating element can in this case be two separate parts, for example consisting of a plastic material. However, it is also conceivable for the bearing arm and the actuating element to be formed as an integral plastic part with a film hinge.

In an alternative embodiment, the bearing arm can be mounted displaceably linearly relative to the busbar on the busbar in the region of the point at which the resting limb of the clamping spring rests. The bearing arm is in this case preferably formed integrally with the actuating element. In this way, actuation of the cage strain spring can be realized by opening the clamping point by means of a linearly displaceable thruster element, which is passed through the slot in the clamping section and/or the actuating section. In this variant too, a very compact and self-supporting actuating element is realized, in which a relatively large actuating force is not transmitted to the insulating housing.

A particularly advantageous, self-supporting variant with a linearly displaceable actuating element is achieved if the bearing arm is fixed on the busbar, and the actuating element is arranged linearly movably relative to the busbar on the bearing arm.

The invention will be explained by way of example in more detail below with reference to the attached drawings, in which.

Figure 1:
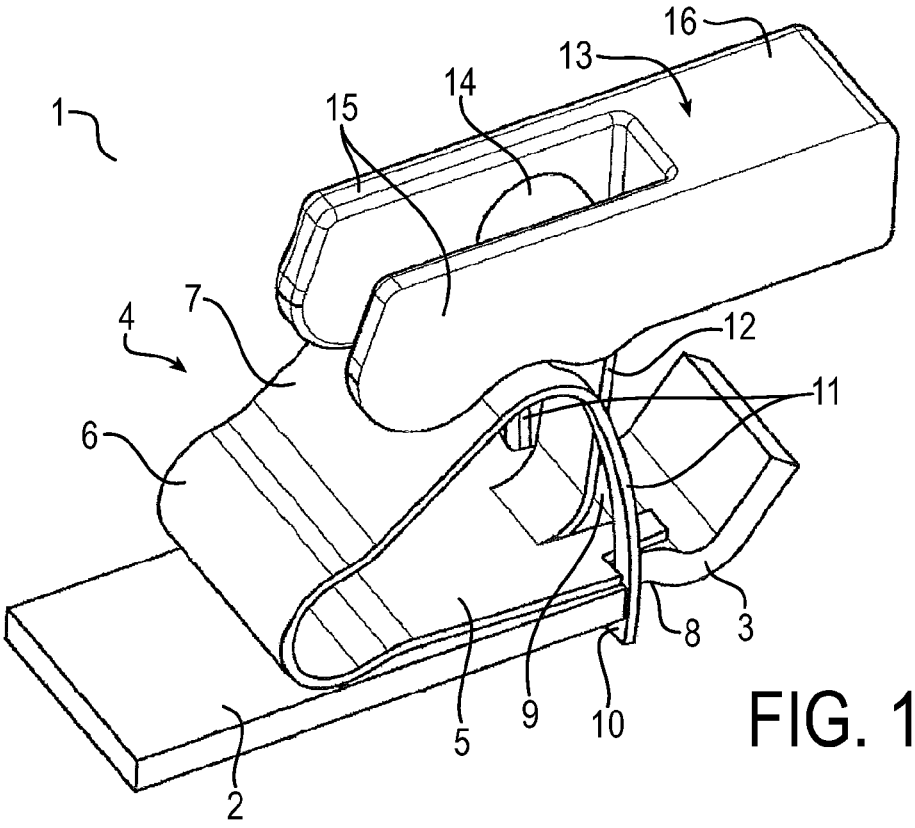
FIG. 1 shows a perspective view of a first embodiment of a spring force terminal element comprising a busbar, a cage strain spring, and an actuating element mounted pivotably on a bearing arm formed integrally with the busbar.

FIG. 1 shows a perspective view of a first embodiment of a spring force terminal element 1. The spring force terminal element 1 has a busbar 2, whose free end is bent away upwards in a manner known per se so as to form a clamping edge 3 which curves downwards. The busbar 2 is narrower in the region of the free end. There, a clamping spring 4 is suspended in the busbar 2. The clamping spring 4 is in the form of a cage strain spring known per se. A cage strain spring is a loop-like structure consisting of a spring-elastic material. The clamping spring 4 has a resting section 5, which is supported on the busbar 2. In the exemplary embodiment illustrated, the resting section rests at least partially on the busbar 2. A spring bend 6 adjoins the resting section 5. The spring bend 6 merges with an actuating section 7, which is opposite the resting section 5. It becomes clear that the resting section 5 and the actuating section 7, together with the spring bend 6, are V-shaped in cross section. A clamping section 8 is bent back from the actuating section 7 and extends downwards from the actuating section 7 in the direction of the resting section 5 and the busbar 2.

The clamping section 8 has a conductor leadthrough opening 9 in the central region, said conductor leadthrough opening being limited at the lower free end of the clamping section 8 by a transverse web 10. A conductor introduced beneath the busbar 2 is then guided through the conductor leadthrough opening 9 when the transverse web 10 is moved downwards by the busbar 2 and is clamped to the busbar 2 by the transverse web 10. The conductor is preferably clamped to the exposed clamping edge 3 of the busbar 2.

The clamping section 8, by virtue of the shaped conductor leadthrough opening 9, has two lateral marginal webs 11, which are connected to one another in the lower region by the transverse web 10.

The free space created in the clamping section 8 by the conductor leadthrough opening 9 is used for a bearing arm 12, which extends out of the direction of the busbar 2 through the slot formed with the aid of the conductor leadthrough opening 9 in the exemplary embodiment illustrated in the clamping section 8 and preferably ends above the transition between the actuating section 7 and the clamping section 8. It becomes clear that a separate actuating element 13 in the form of a lever arm is mounted pivotably on the bearing arm 12. For this purpose, the free end of the bearing arm 12 is bent back and a bearing spindle (not shown) is suspended in the bent-back end 14 of the bearing arm 12.

The actuating element 13 has two actuating fingers 15 which are spaced apart from one another and between which the bearing arm 12 is accommodated. The actuating fingers 15 merge with a top part 16 which protrudes forwards and which connects the actuating fingers 15 to one another. The top part 16 and the actuating fingers are formed integrally from a plastic material together with the bearing spindle (not shown).

The actuating fingers 15 have a curved shape matched to the actuating section 7 in the direction of the clamping spring 4 adjoining the actuating section 7 in such a way that the free ends of the actuating fingers 15 migrate downwards in the direction of the busbar 2 and the resting section 5 when the top part 16 is pivoted upwards and in the process press the actuating section 7 in the direction of the resting section 5. In this case, the transverse web 10 of the clamping section 8 migrates towards the opening in the clamping point, formed by the transverse web 10 and the busbar 2, downwards away from the busbar 2.

Figure 2:
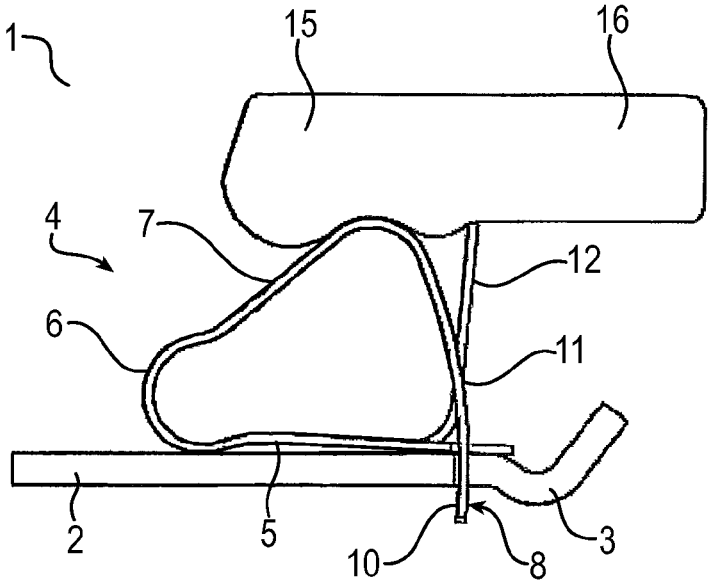
FIG. 2 shows a side view of the spring force terminal connection shown in FIG. 1.

FIG. 2 shows the spring force terminal connection 1 shown in FIG. 1 in a side view. It is shown that the bearing arm 12 is formed integrally with the clamping spring 4. It is punched or cut free from the sheet-metal part of the resting section 5 and is bent back in the region of the free end of the resting section 5 out of said resting section upwards opposite to the direction of extent of the clamping section 8.

It is shown that the bearing arm 12 is not guided laterally past the clamping spring 4, but is arranged in the region between the side edges of the clamping spring 4. In the exemplary embodiment illustrated, the bearing arm 12 is passed through the conductor leadthrough opening 9 of the clamping section 8 between the marginal webs 11 of the clamping section 8.

Figure 3:
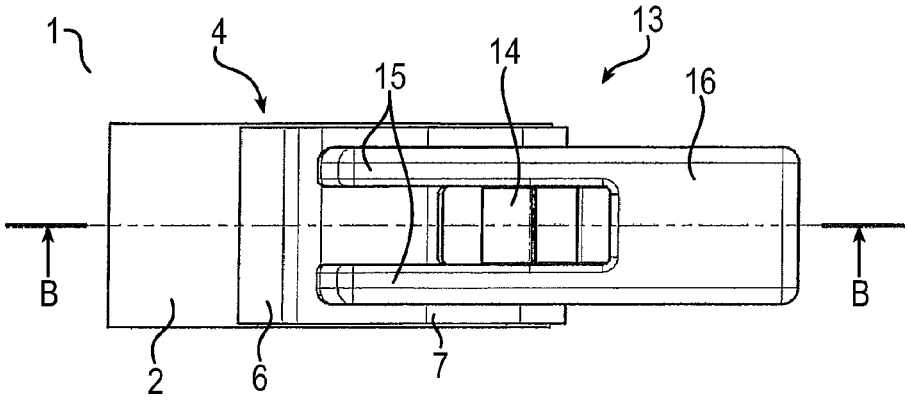
FIG. 3 shows a plan view of the spring force terminal connection shown in FIGS. 1 and 2.

FIG. 3 shows a plan view of the spring force terminal connection shown in FIGS. 1 and 2. It is shown that the actuating element 13 has a top part 16 with actuating fingers 15 integrally adjoining said top part. The actuating fingers 15 are thus spaced so far apart from one another that they accommodate the bearing arm 12 with the bent-back free end 14 between them in order to mount the actuating element 13 pivotably on the bearing arm 12.

Figure 4:
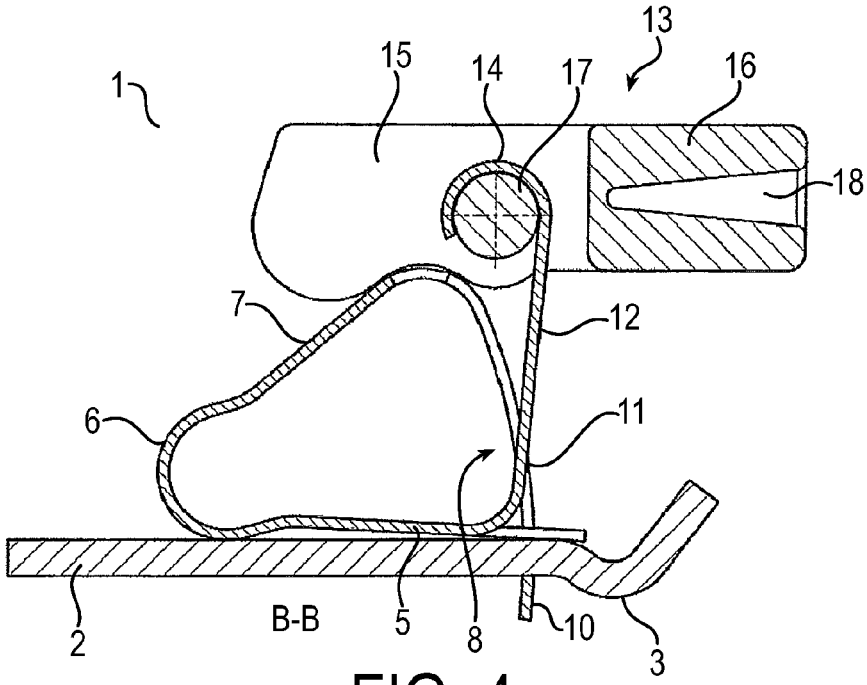
FIG. 4 shows a sectional side view in the section B-B of the spring force terminal connection shown in FIGS. 1 to 3.

This becomes even clearer from the sectional side view in the section B-B in FIG. 4. Here, it can be seen that a bearing spindle 17 extends in the width direction (i.e. in the viewing direction) of the spring force terminal connection 1 transversely to the bearing arm 12. It can be seen that the bearing spindle 17 is cylindrical and that free end 14 of the bearing arm 12 which is bent back by more than 180 degrees is snapped onto the bearing spindle 17. Thus, the actuating element 13 is mounted pivotably on the bearing arm 12. By virtue of the free end 14 being bent through more than 180 degrees, the bearing spindle 17 is fixedly surrounded by the free end 14 and cannot easily expand downwards.

It is furthermore shown that the top part 16 has an actuating opening 18 which extends from the right to the left in the rest position illustrated in the conductor plug-in direction, i.e. in the illustrated sectional side view. The actuating opening 18 is provided for receiving the free end of an actuating tool, such as a screwdriver, for example, with which the lever arm is extended upwards for pivoting the actuating element 13 and the actuation is facilitated. The actuating opening 18 is therefore formed so as to taper conically towards the bottom in the exemplary embodiment illustrated.

Figure 5:
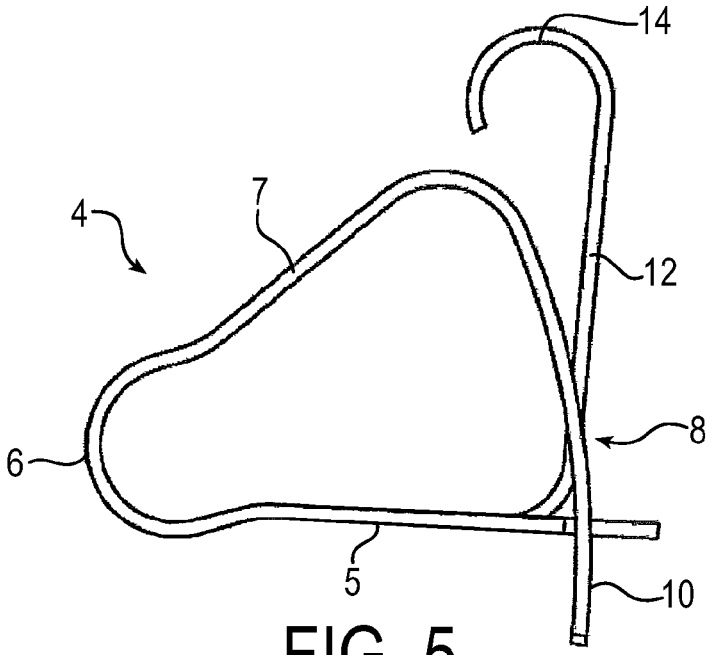
FIG. 5 shows a side view of a clamping spring for the first embodiment of the spring force terminal connection shown in FIGS. 1 to 4.

FIG. 5 shows a side view of the clamping spring 4, as is used in the previously described exemplary embodiment of the spring force terminal connection 1. In contrast to the cage strain springs known per se, a bearing arm 12 is bent out of the resting section 5 in the central region adjoining the free end of the resting section 5. The bearing arm 12 extends from the resting section 5 in the opposite direction to the direction of extent of the clamping section 8 and ends above the transition between the actuating section 7 and the clamping section 8 in a bent-back free end 14. Then, a suitably formed actuating element is mounted on the bearing arm 12 with the bent-back free end 14. In this way, a self-supporting, lever-actuated spring force terminal connection comprising a cage strain spring is realized which is very compact, saves on materials and has a simple design.

Figure 6:
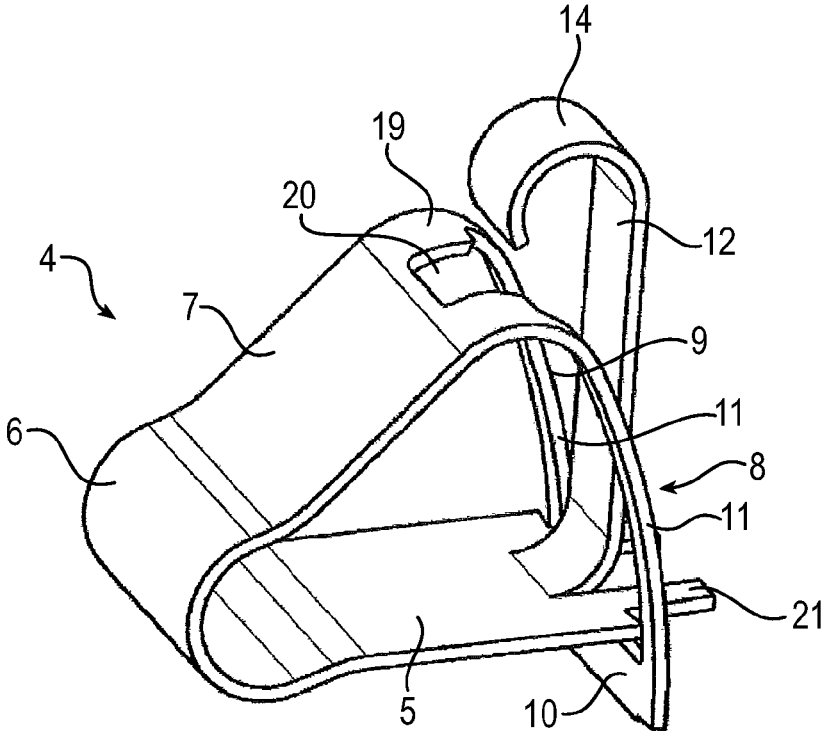
FIG. 6 shows a perspective view of the cage strain spring shown in FIG. 5.

FIG. 6 shows a perspective view of the clamping spring 4 shown in FIG. 5. It can be seen more clearly from this figure that the clamping section 8 has a conductor leadthrough opening 9, whilst preserving marginal webs 11, said conductor leadthrough opening extending as far as a bend at the transition to the actuating section 7. A cutout 20 which is narrower than the conductor leadthrough opening 9 is provided in the top part of the bend 19 at the transition between the clamping section 8 and the actuating section 7, with it being possible for the bearing arm 12 to dip into said cutout when the actuating section 7 is pressed downwards in the direction of the resting section 5.

The free end of the resting section 5 ends in narrower protruding lugs 21, with the marginal webs 11 of the clamping section 8 being guided past said lugs.

Figure 7:
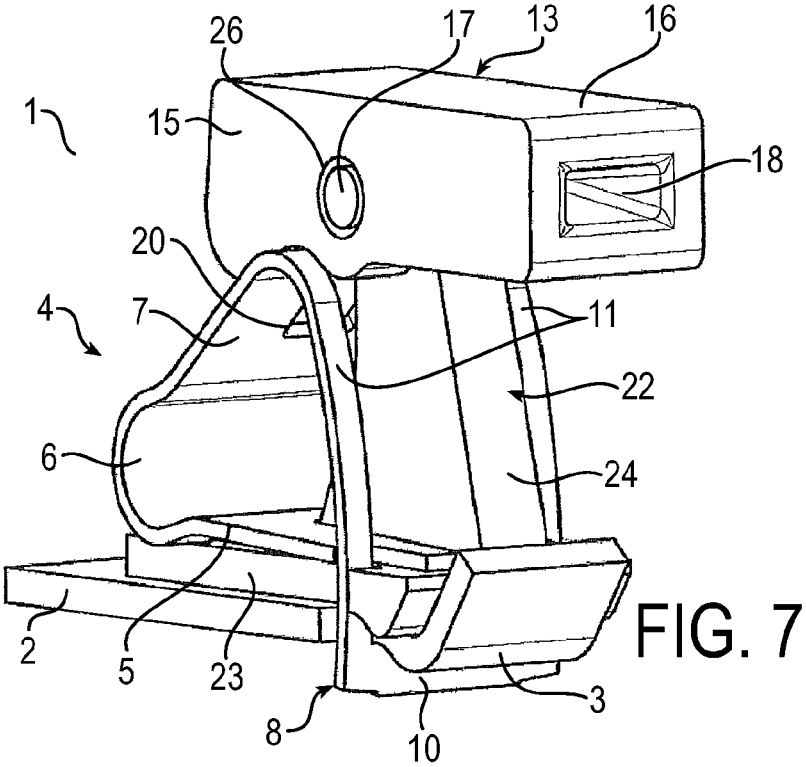
FIG. 7 shows a perspective view of a second embodiment of a spring force terminal connection having a separate bearing arm arranged between the resting section and the busbars and an actuating element articulated on said bearing arm in a front side view.

FIG. 7 shows a perspective view of a second embodiment of a spring force terminal connection 1. In turn, said spring force terminal connection consists of a clamping spring 4 in the form of a cage strain spring, a busbar 2 and an actuating element 13. In this embodiment, the bearing arm 22 is not formed integrally with the clamping spring 4, as in the first embodiment, but is formed as a separate part. The bearing arm 22 is preferably a plastic part. It has a base 23 positioned between the busbar 2 and the resting section 5 of the clamping spring. An arm section 24 protruding vertically on the base 23 extends perpendicularly upwards from the base 23. The arm section 24 is arranged in the free space formed by the marginal webs 11 of the clamping section 8 and thus substantially in the space spanned by the cage strain spring. The actuating element 13 is mounted pivotably at the free end of the arm section 24, which is opposite the base 23. For this purpose, a bearing spindle 17 is passed through a bearing opening 25 in the actuating fingers 15 of the actuating element 13, which is accommodated in a corresponding bearing opening (not shown) in the arm section 24. In this way, the actuating element 13 is held pivotably on the arm section 24 of the bearing arm 22.

Figure 8:
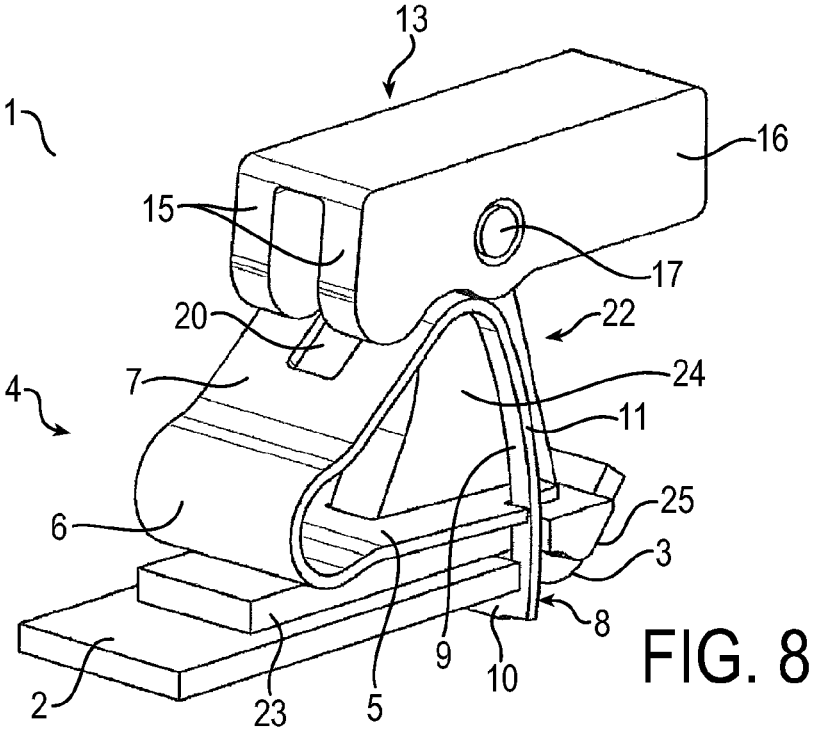
FIG. 8 shows a perspective view of the spring force terminal connection shown in FIG. 7 in a rear side view.

FIG. 8 shows the second embodiment of the spring force terminal connection 1 from FIG. 7 in the perspective rear side view. It can be seen that the actuating element 13, as in the case of the first embodiment, has actuating fingers 15 which are arranged spaced apart from one another and which rest with their curved lower side on the actuating section 7 of the clamping spring 4.

It can also clearly be seen that the bearing arm 22 is pushed with its base 23 through the conductor leadthrough opening 9 in the clamping section 8 of the clamping spring 4 in order to be positioned between the busbar 2 and the resting section 5. Thus, the resting section 5 is supported indirectly on the busbar 2 and rests directly on the base 23 of the bearing arm 22.

Figure 9:
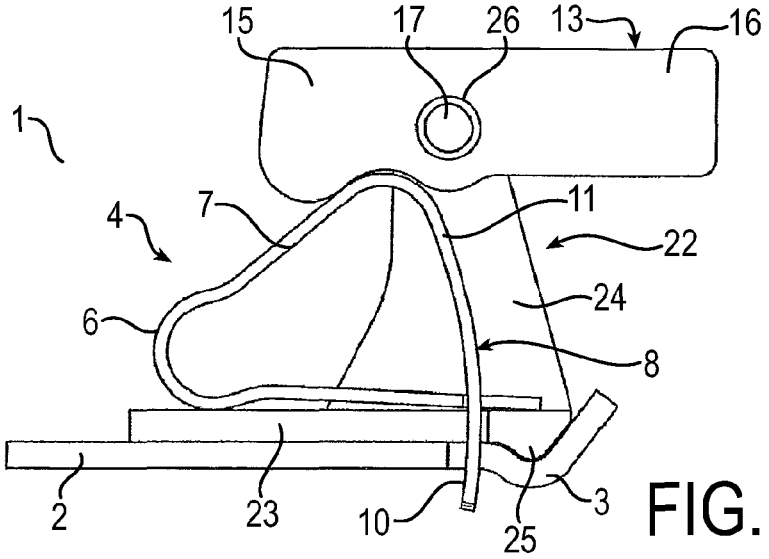
FIG. 9 shows a side view of the second embodiment of the spring force terminal connection shown in FIGS. 7 and 8.

FIG. 9 shows a side view of the spring force terminal connection 1 shown in FIGS. 7 and 8. It can be seen here that the base 23, at its right-hand free end adjoined by the arm section 24 of the bearing arm 22, has a downwardly pointing protrusion 25, which dips into the curvature provided so as to form a clamping edge 3 at the free end of the busbar 2. In this way, the bearing arm 22 is fixed in position on the busbar 2.

Figure 10:
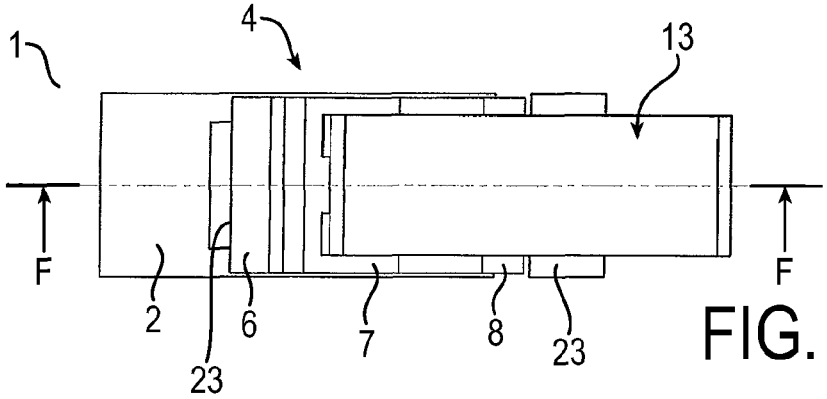
FIG. 10 shows a plan view of the spring force terminal connection shown in FIGS. 7 to 9.

FIG. 10 shows a plan view of the spring force terminal connection 1 shown in FIGS. 7 to 9. In contrast to the first embodiment, the actuating element 13 is completely closed on the upper side so that the actuating fingers 15 are connected to one another not only by the top part 16, but also on the upper side.

Figure 11:
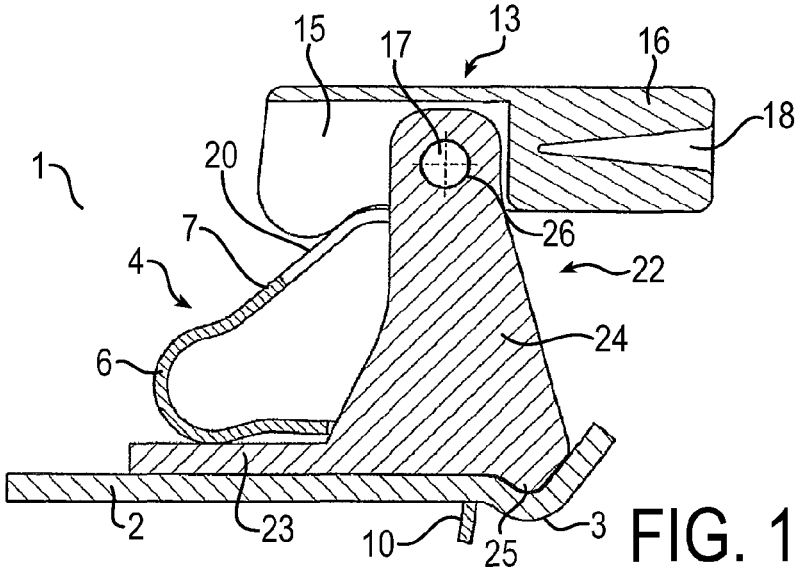
FIG. 11 shows a sectional side view of the second embodiment of the spring force terminal connection in the section F-F.

FIG. 11 shows a sectional side view of the spring force terminal connection 1 of the second embodiment shown in FIGS. 7 to 10. It can be seen from FIG. 11 that the top part 16 of the actuating element 13 has a depression 18, which tapers conically towards the bottom, on the front end face for receiving an actuating element. To this extent, reference can be made to the statements in respect of the first embodiment.

It can also be seen that the arm section 24 of the bearing arm 22 has a bearing opening 26 at the upper free end, which is opposite the base 23, with the bearing spindle 17 being plugged through said bearing opening 26.

Figure 12:
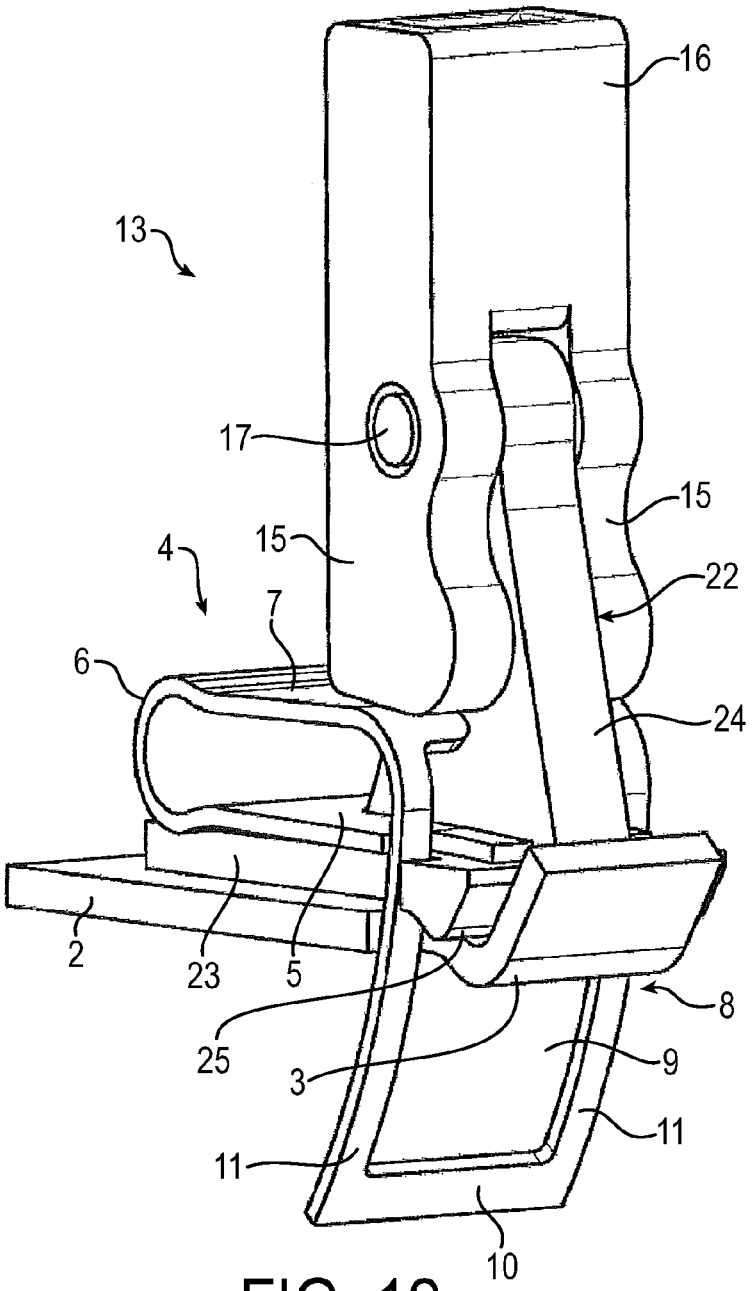
FIG. 12 shows a perspective view of the second embodiment of the spring force terminal connection having a raised actuating element in the open position.

FIG. 12 shows a perspective view of the second embodiment of a spring force terminal connection 1 from the front in the open position. In this case, the actuating element 13 is pivoted upwards to approximately 90 degrees with the top part 16, in contrast to the previously illustrated rest position. The actuating fingers 15 in this case migrate with their free ends relative to the bearing spindle 17 and the top part 16 downwards in the direction of the busbar 2 so that the actuating section 7 is pushed down towards the resting limb 5 and the busbar 2. As a result, the clamping point is opened. The clamping point is formed by the transverse web 10, which delimits the conductor leadthrough opening 9 at the bottom, and the clamping edge 3 on the busbar 2. An electrical conductor can now be plugged forwards, in the viewing direction, i.e. from right to left, through the conductor leadthrough opening 9 in the clamping section 8 of the clamping spring 4 in order to be clamped electrically conductively to the busbar 2 once the actuating element 13 has been pivoted into the previously illustrated rest position between the transverse web 10 and the clamping edge 3 owing to the spring force of the clamping spring 4.

It can be seen that the separate bearing arm 22 is accommodated in the slot in the clamping section and partially also in the actuating section of the clamping spring 4 and extends through the slot, which is formed by the conductor leadthrough opening 9 and the cutout 20, in the clamping spring 4.

Figure 13:
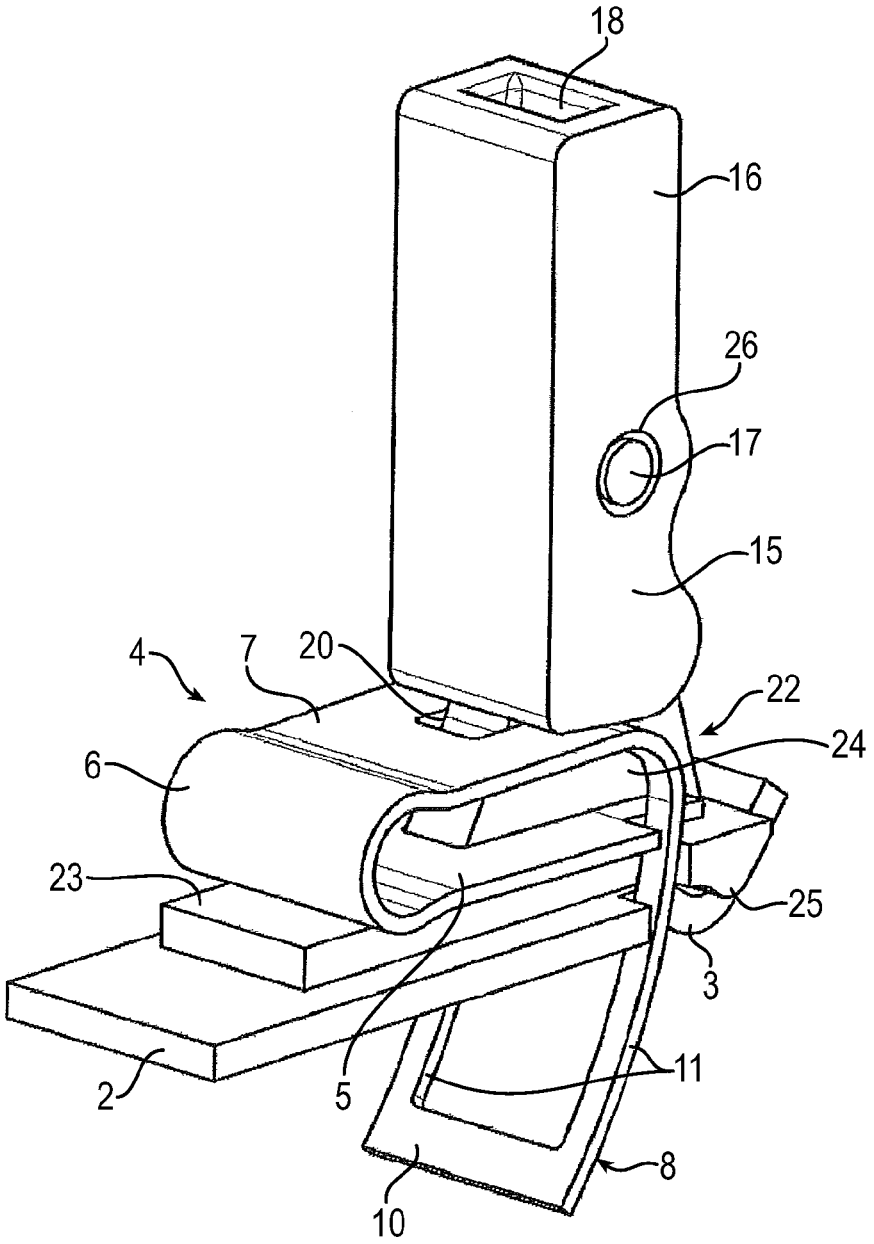
FIG. 13 shows a perspective rear side view of the open spring force terminal connection shown in FIG. 12.

This becomes even clearer from the perspective rear side view in FIG. 13. It can be seen here that the arm section 24 is passed from the base 23 additionally through a cutout 28 in the resting section 5. These cutouts in the clamping spring 4 are arranged, when viewed in the width direction, between the side edges of the clamping spring 4 and preferably centrally. The bearing arm 22 is therefore arranged on half the width of the busbar 2 and the clamping spring 4.

Figure 14:
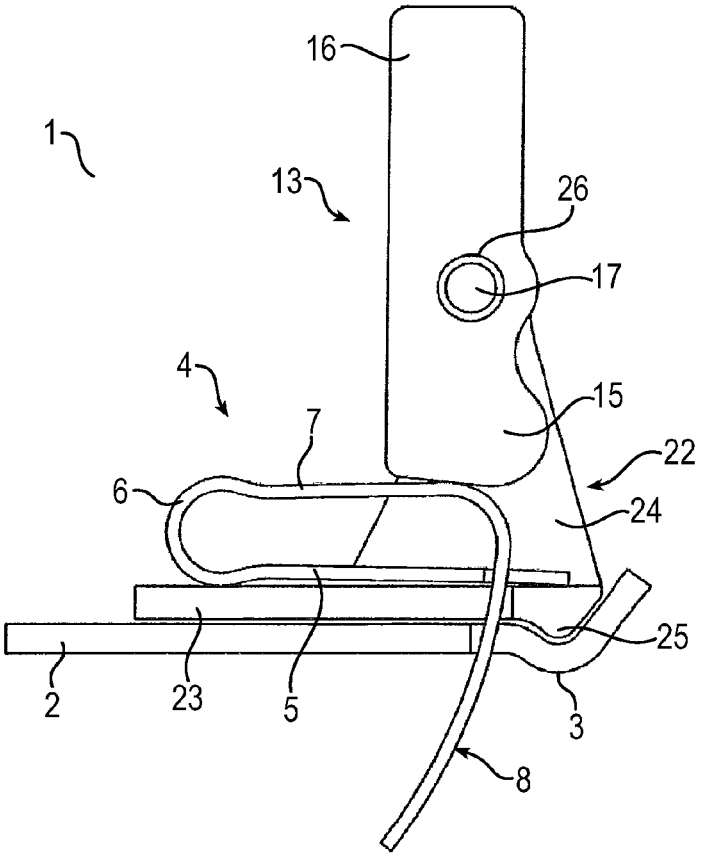
FIG. 14 shows a side view of the open spring force terminal connection shown in FIGS. 12 and 13.

FIG. 14 shows a side view of the second embodiment of the spring force terminal connection 1 in the open position. In this open position illustrated, the actuating element 13 is preferably self-locked. This is achieved by virtue of the fact that the actuating section 7 of the clamping spring 4 now exerts a force on the actuating element 13, which is directed approximately towards the bearing spindle 17 in this open position. Thus, a tilting moment which would cause the actuating element 13 to pivot back into the rest position is avoided.

The curved shape of the actuating fingers 15 is therefore matched to the kinematics of the actuating element 13 and the clamping spring 4 in such a way that best-possible force and moment distribution is ensured in each angular position of the actuating element 13.

Figure 15:
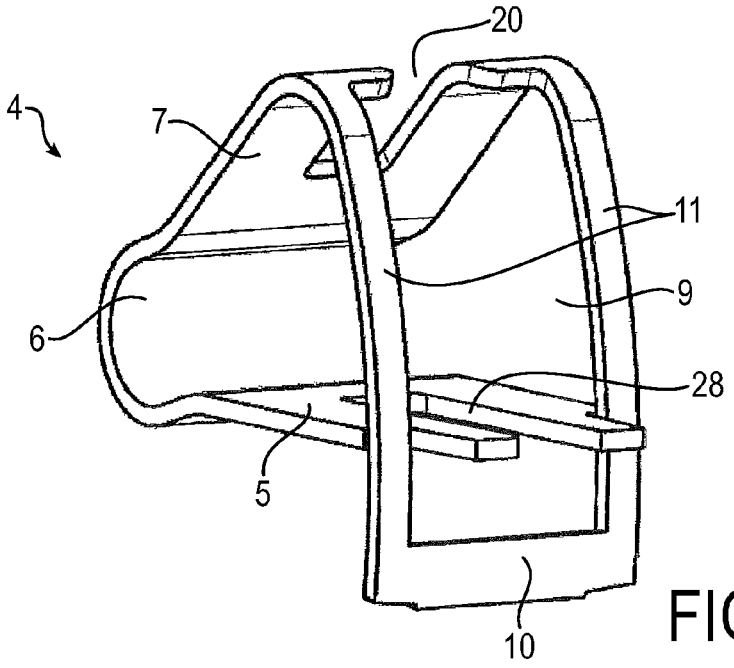
FIG. 15 shows a perspective view of the cage strain spring for the second embodiment of the spring force terminal connection shown in FIGS. 7 to 14.

FIG. 15 shows a perspective view of the clamping spring 4 of the second embodiment of the spring force terminal connection 1 in the installed position. In comparison with the clamping spring 4 for the first embodiment, the cutout 20 is longer and extends further into the actuating section 7. This is caused by virtue of the fact that the arm section 24 of the bearing arm spans a greater, triangular area than the bearing arm 12 of the first embodiment, which is in the form of a flat sheet-metal element.

It can furthermore be seen that a cutout 28 is provided in the resting section 5, through which cutout the arm section 24 of the bearing arm 22 is passed.

Figure 16:
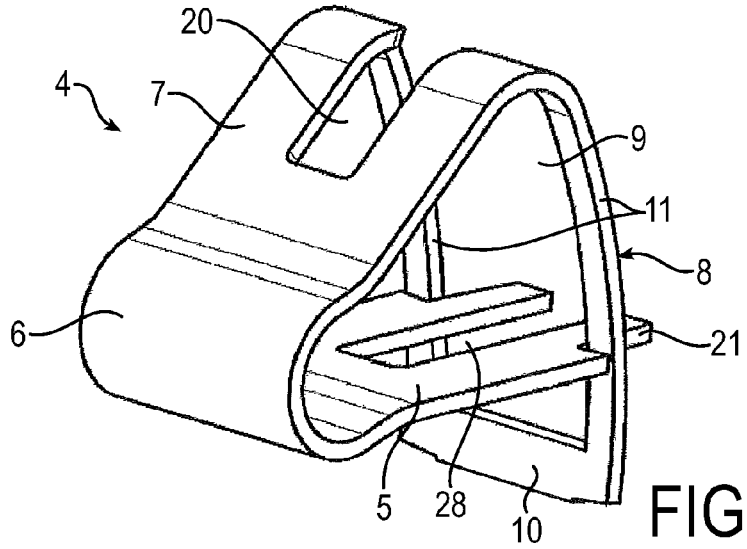
FIG. 16 shows a perspective rear side view of the spring force terminal connection shown in FIG. 15.
Figure 17:
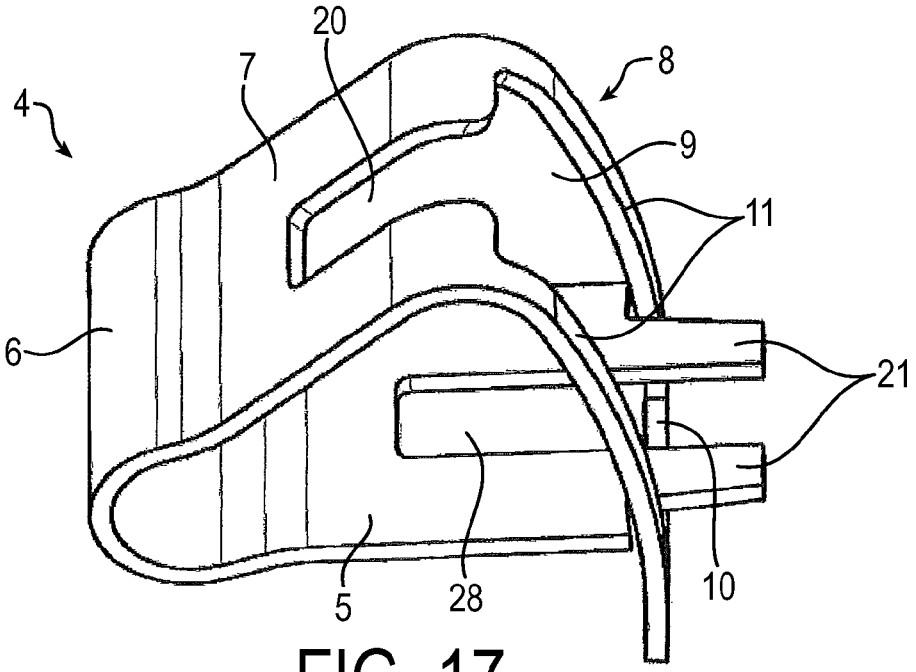
FIG. 17 shows a perspective view of the cage strain spring shown in FIGS. 15 and 16 from above.

This becomes clearer from the perspective illustration in FIGS. 16 and 17, which show the clamping spring 4 in the perspective rear side view and the perspective view at an angle from above. The cutout 20 forms, together with the conductor insertion opening 9, a first slot, and the cutout 28 forms a second slot, through which the bearing arm 22 can extend from the lower side of the resting section 5 upwards in the direction of the transition between the actuating section 7 and the clamping section 8. These cutouts 20, and the conductor leadthrough opening 9 are delimited on both sides by the side edges of the clamping spring 4 and in particular by the marginal webs 11 of the actuating section 8 or are located within the space formed by the marginal webs 11 and the side edges of the clamping spring 4.

Figure 18:
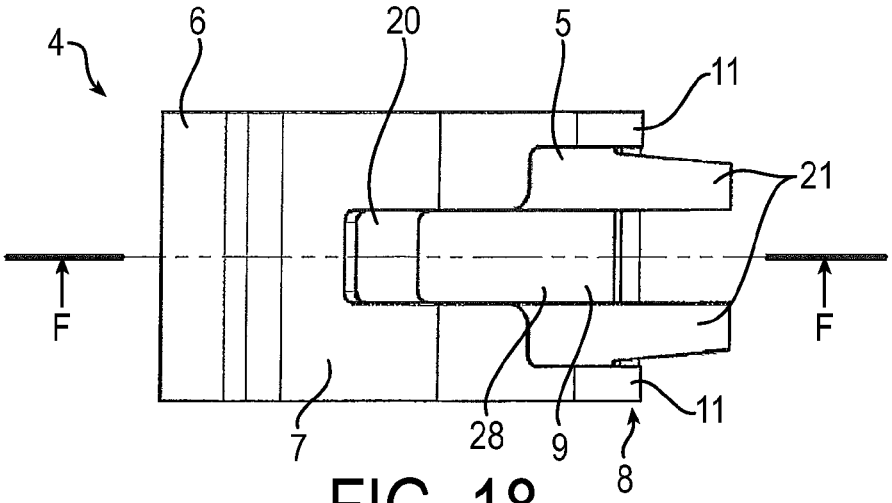
FIG. 18 shows a plan view of the cage strain spring shown in FIGS. 15 to 17.

FIG. 18 shows a plan view of the clamping spring 4 shown in FIGS. 15 to 17. From this figure it is clear that the cutout 20, the conductor leadthrough opening 9 and the cutout 28 are arranged in the bearing limb 5 centrally, when viewed in the width direction (from the bottom to the top in the illustration).

Figure 19:
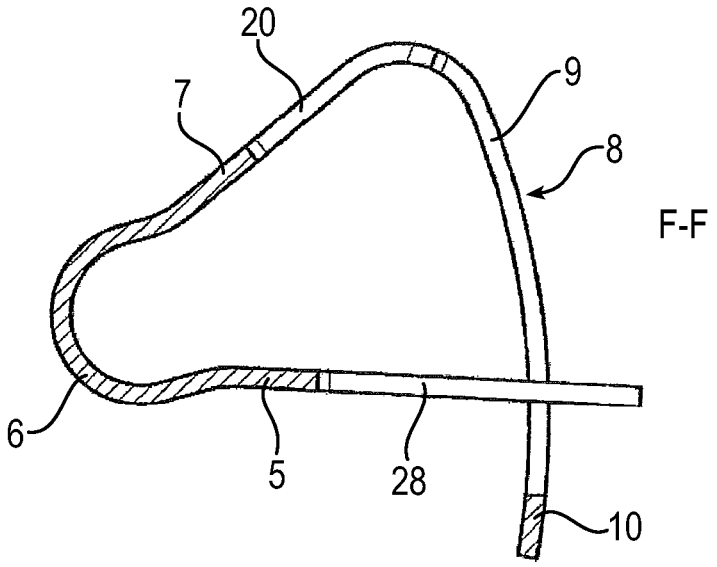
FIG. 19 shows a side view of the cage strain spring shown in FIGS. 15 to 18.

FIG. 19 shows a sectional side view in the section F-F of the clamping spring 4 from FIG. 18. It can be seen from the hatched sections that spring sheet-metal material is provided there in the section F-F for the transverse web 10, the actuating section 7, the spring bend 6 and the resting section 5. In addition, it becomes clear that a slot is created by the cutout 20 and the conductor leadthrough opening 9 at the transition between the actuating section 7 and the clamping section 8 in the central section F-F, which slot is delimited first at the free end of the clamping section 8 by the transverse web 10. The resting section 5 likewise has a slot which runs as far as the free end and is formed by the cutout 28.

Figure 20:
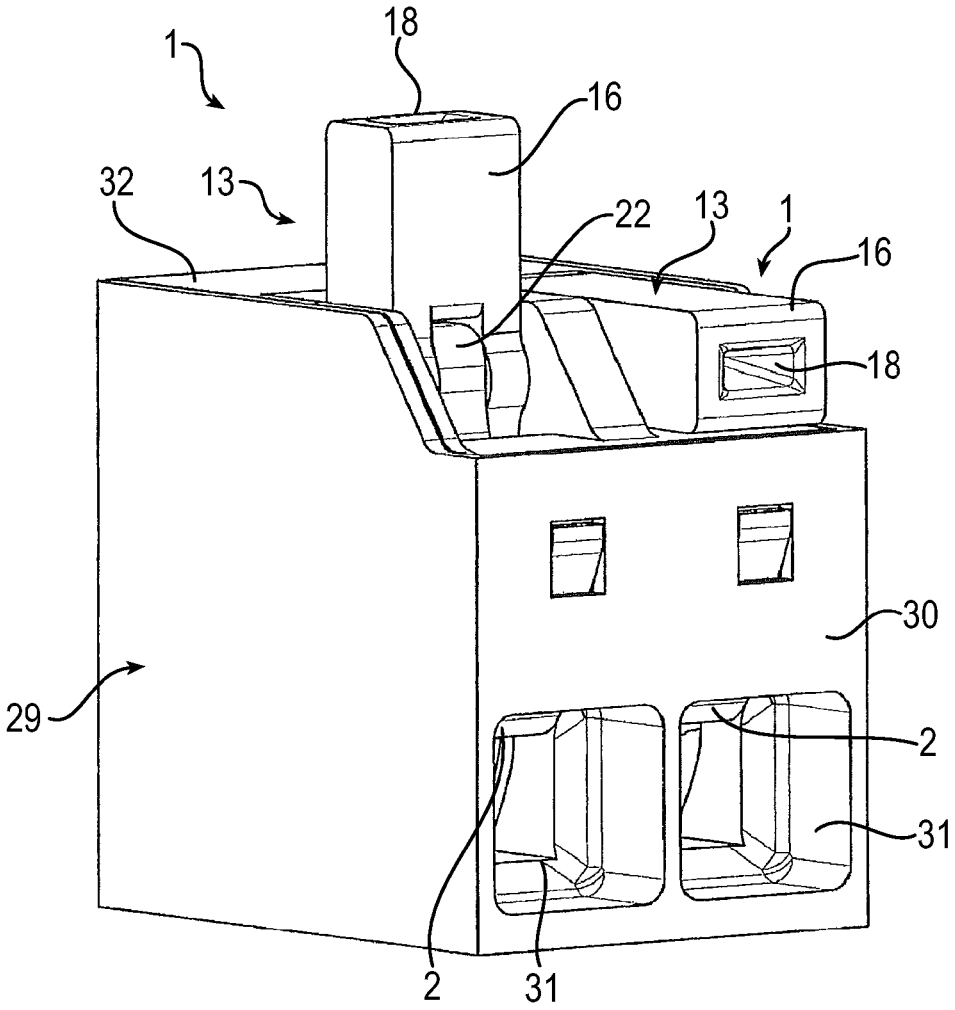
FIG. 20 shows a perspective view of an electrical device comprising an insulating housing and spring force terminal connections installed therein from the second embodiment.

FIG. 20 shows a perspective view of an electrical device, in which two spring force terminal connections of the type mentioned at the outset are built into an insulating housing 29. In the embodiment illustrated, the second embodiment of the spring force terminal connection 1 has been used. Equally, however, the spring force terminal connection of the first exemplary embodiment can also be used.

The spring force terminal connections 1 are self-supporting and can be installed together with the actuating element 13, the busbar 2 and the clamping spring 4 as well as the bearing arm 22, in a preassembled state, in the insulating housing. Conductor insertion openings 31 are provided in the front end side wall 30 of the insulating housing 29, said conductor insertion openings opening out into the space directly beneath the busbar 2 in order to clamp an electrical conductor on the busbar 2 by means of the clamping spring 4.

The top part 16 of the actuating elements 13 protrudes in each case out of the housing through a corresponding cutout and is preferably, on the upper side, aligned flush with the upper side 32 of the insulating housing in the rest position (right-hand spring force terminal connection). Thus, a closed, block-like connection terminal is provided.

Figure 21:
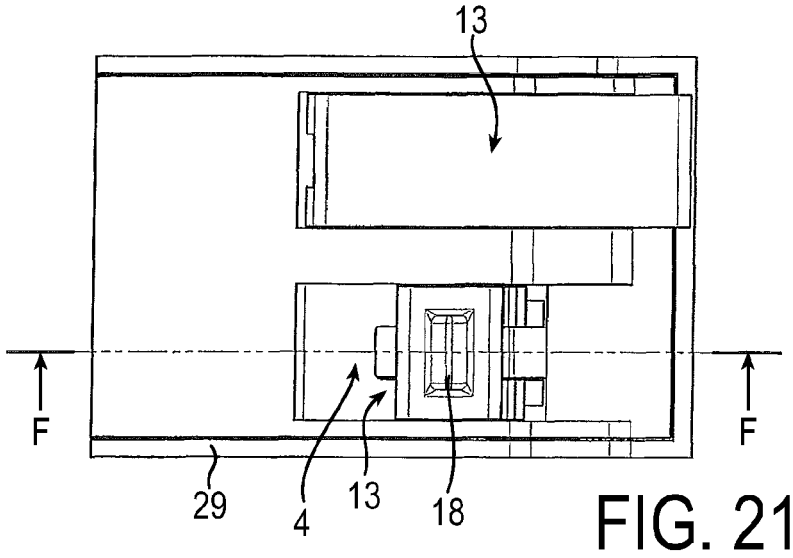
FIG. 21 shows a plan view of the electrical device shown in FIG. 20.

This becomes clearer from the plan view of the electrical device from FIG. 20 in FIG. 21.

Figure 22:
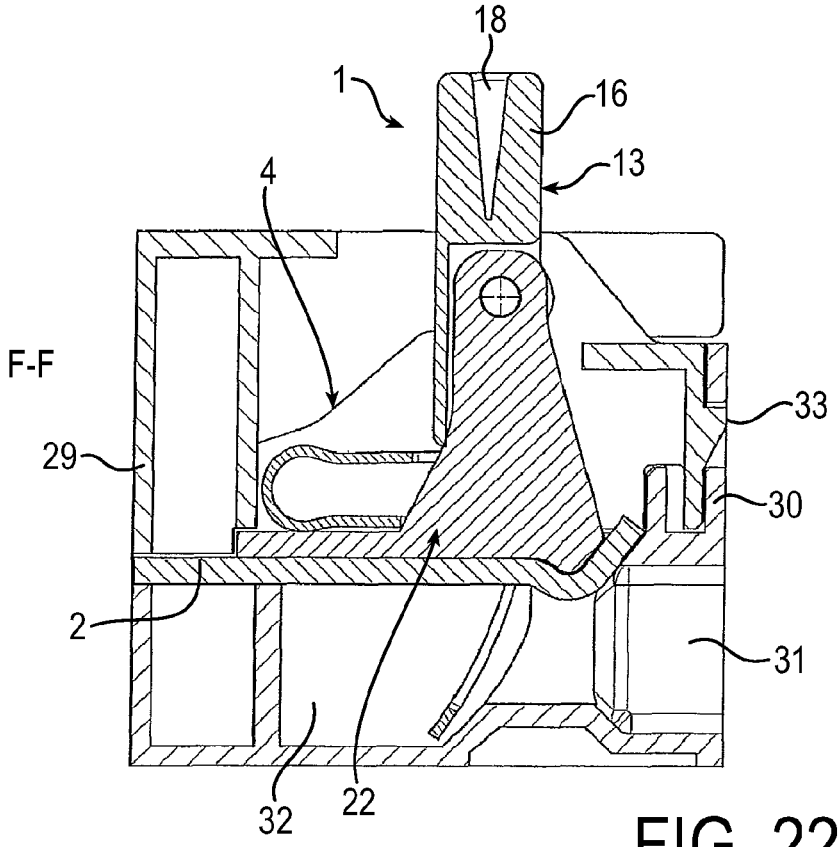
FIG. 22 shows a sectional side view through the electrical device shown in FIGS. 20 and 21 in the section F-F.

FIG. 22 shows a sectional side view in the section F-F through the spring force terminal connection 1 which is in the open position. In this case, it can be seen that the spring force terminal connection 1 together with the busbar 2, the clamping spring 4, the bearing arm 22 and the actuating element 13 as a whole is fixed in the insulating housing 29. It can be seen that the conductor insertion openings 31 in the end side wall 30 of the insulating housing 29 open out in the clamping space 32 beneath the busbar 2. The insulating housing 29 is formed in several parts and can be latched to one another by means of a latching apparatus 33. For example, the latching apparatus 33 has, on one part, a latching lug, which latches into a latching opening in the other part, in order to fixedly connect the two housing parts to one another once the spring force terminal connection 1 has been installed.

Figure 23:
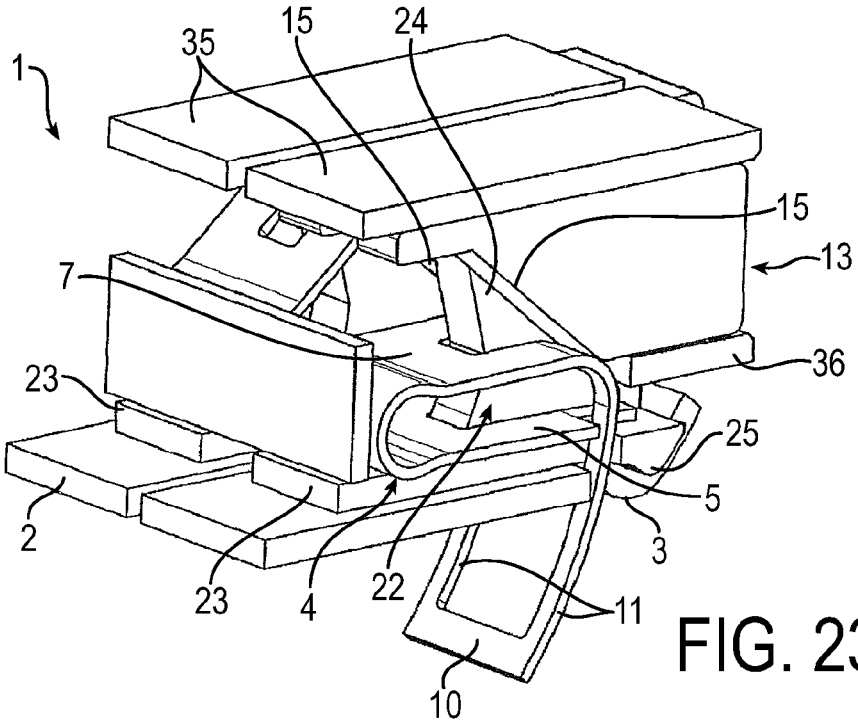
FIG. 23 shows a perspective view of a third embodiment of a spring force terminal connection having a linearly movable actuating element from the rear side.

FIG. 23 shows a perspective view of a third embodiment of a spring force terminal connection 1. In the exemplary embodiment illustrated, two spring force terminal connections 1 in the open position and rest position are arranged next to one another. The front spring force terminal connection 1 is in the open position, in which the clamping point is open, while the rear spring force terminal connection is in the rest position with the clamping point closed. In contrast to the previously described embodiments, the actuation does not take place by pivoting of an actuating element 13 (actuating lever), but by linear displacement of an actuating element 13 in the form of an actuating thruster.

In turn, a bearing arm 22 extends through slots in the clamping spring 4. To this extent, the clamping spring is comparable to the clamping spring for the previously described second embodiment. Reference is made to the details given in this regard and to FIGS. 15 to 19.

The bearing arm 22 is likewise mounted with a base 23 between the resting section 5 of the clamping spring 4 and the busbar 2. The base 23 in turn has a protrusion 25, which dips into a corresponding trough so as to form a clamping edge 3 on the busbar 2 in order to fix the bearing arm 22 in terms of position on the busbar 2.

The actuating element 13 is manufactured as a separate part from the bearing arm 22 and is mounted linearly displaceably on the arm section 24 of the bearing arm 22. The actuating element 13 in turn has two actuating fingers 15 which are spaced apart from one another, with the arm section 24 being accommodated between said actuating fingers. The rear end faces of the actuating fingers 15 are arranged so as to be inclined and can possibly also follow a specific curve shape. They rest on the actuating section 7 at the transition to the clamping section 8 on the clamping spring 4. During a linear displacement of the actuating element 13, i.e. from right to left in the view in FIG. 23, the clamping spring is transferred from the rear rest position illustrated into the front open position illustrated by virtue of the actuating section 7 being pressed downwards in the direction of the clamping section 8.

Figure 24:
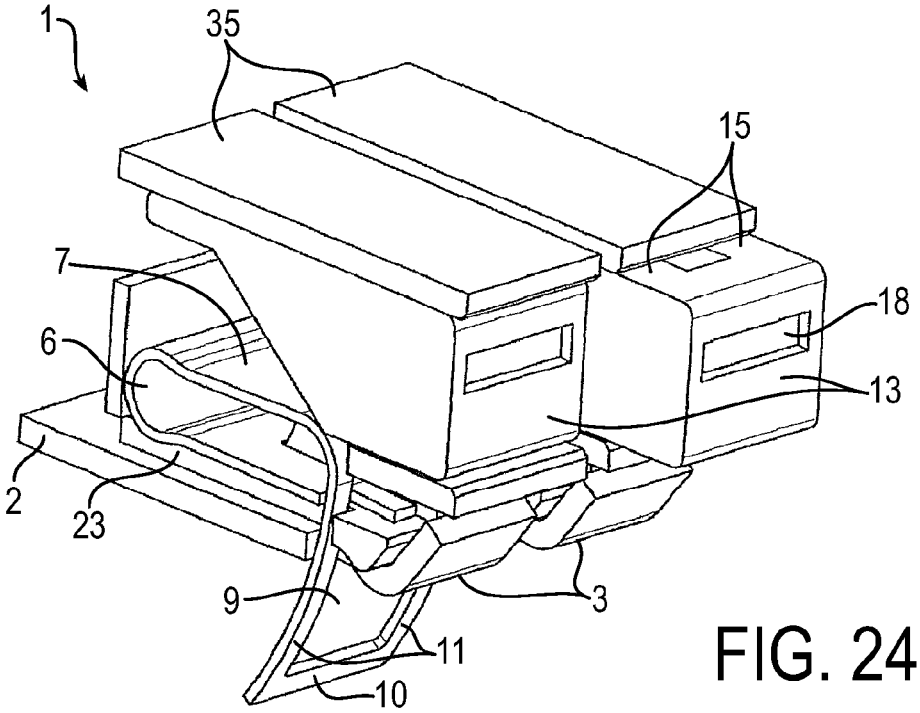
FIG. 24 shows a perspective view of the third embodiment of a spring force terminal connection in a view from the front.

This becomes clearer again from FIG. 24, which shows that the right-hand actuating element 13 in the rest position is pushed forwards. The left-hand actuating element 13 in the open position, on the other hand, is pressed rearwards in the direction of the spring bend 6 of the clamping spring 4.

In order to prevent the actuating element 13 from tipping or falling out upwards, the bearing arm 22 has a cover plate 35, which is oriented parallel to the busbar 2 or the base 23, on its upper free end. In this way, in turn a self-supporting spring force terminal connection 1 is provided which can be installed in the preassembled state into an insulating housing. The busbar 2 can in this case be part of the preassembled spring force terminal connection 1. However, it is also conceivable for the busbar 2 to be located in the electrical device into which the spring force terminal connection is installed without the preassembled busbar 2. During installation, the spring force terminal connection 1 is then pushed onto the associated busbar 2.

Figure 25:
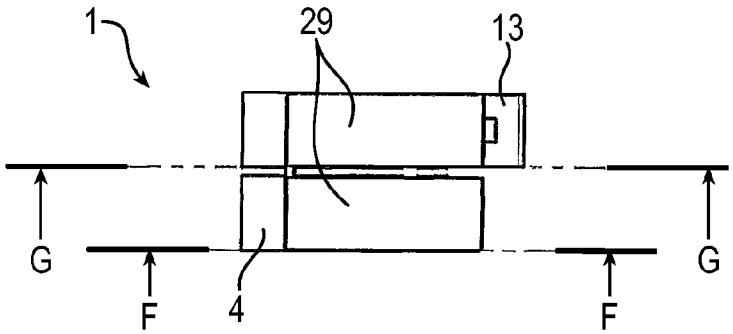
FIG. 25 shows a plan view of two cage strain springs arranged next to one another in the open and closed state of the third embodiment of the spring force terminal connection shown in FIGS. 23 and 24.

FIG. 25 shows a plan view of the third embodiment of the spring force terminal connections 1 shown in FIGS. 23 and 24. It is shown that the upper (rear) spring force terminal connection is in the rest position with a closed clamping point since the actuating element 13 protrudes forwards out of the cover plate 35 counter to the conductor insertion direction (from right to left). In the case of the lower (front) spring force terminal connection 1, the actuating element (no longer visible) is displaced linearly beneath the cover plate 35 so that an actuating force is exerted on the clamping spring 4 and the clamping point is opened.

Figure 26:
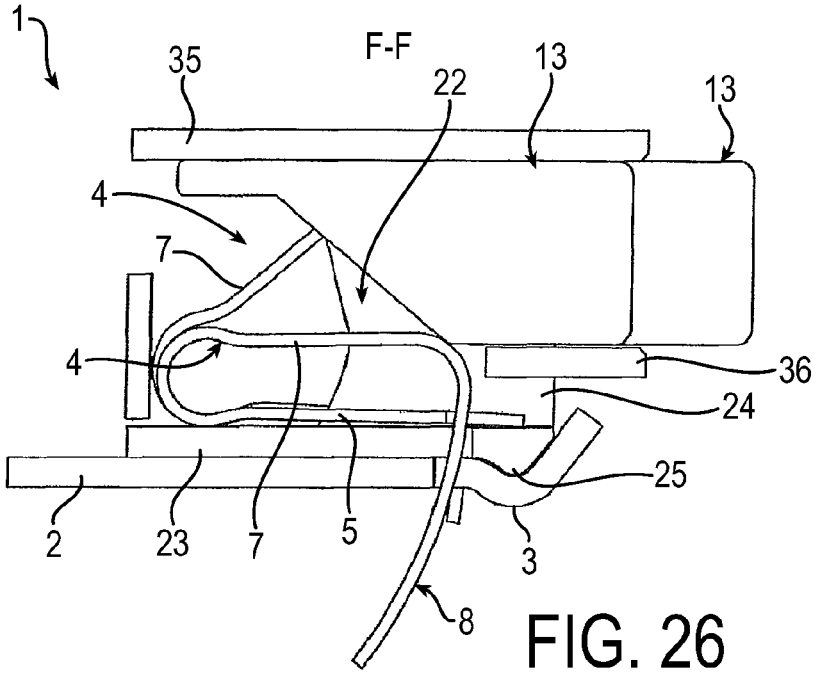
FIG. 26 shows a side view of the third embodiment of the spring force terminal connection in the section F-F of the open cage strain spring.

FIG. 26 shows the lower (front) spring force terminal connection in the open position in the section F-F with the lower closed spring force terminal connection behind said lower spring force terminal connection in the sectional side view. It becomes clear from this that an actuating force can be applied to the clamping spring 4 by virtue of a linear displacement of the actuating element 13 so that the actuating section 7 is pressed downwards in the direction of the resting section 5, the base 23 and the busbar 2.

Figure 27:
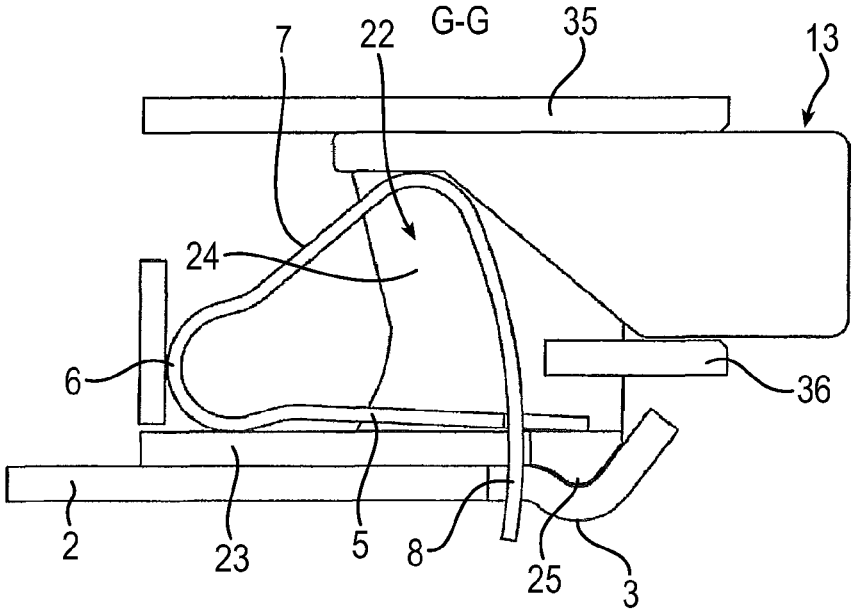
FIG. 27 shows a sectional side view of the third embodiment of the spring force terminal connection in the section G-G of the closed cage strain spring.

FIG. 27 shows a sectional side view in the section G-G of the spring force terminal connection 1 in the rest position.

In comparison with FIG. 27, it becomes clear that the actuating element 13 is accommodated linearly displaceably on the arm section 24 of the bearing arm 22 and is limited on the upper side by the cover plate 35. A further guide plate 36 is arranged beneath the actuating element 13 on the arm section 24, said guide plate being used for guiding the linearly displaceable actuating element 13 on the lower side.

The invention claimed is:

1. A spring force terminal connection comprising:

a busbar, a clamping spring, which has a resting section which is supported on the busbar, a spring bend, which adjoins the resting section, an actuating section, which adjoins the spring bend and is opposite the resting section, and a clamping section, which adjoins the actuating section and extends from the actuating section in the direction of the busbar, wherein the clamping section has a conductor leadthrough opening, and wherein the busbar is passed through the conductor leadthrough opening, and a clamping point for a conductor to be connected is provided between the busbar and a transverse web limiting the conductor leadthrough opening, and comprising an actuating element, which is mounted movably for acting on the actuating section in such a way that the transverse web, which limits the conductor leadthrough opening and forms a clamping point, is movable away from the busbar in the case of a movement of the actuating element into an open position, wherein a bearing arm, which is fixed in position relative to the busbar and the resting section supported on the busbar extends out of the direction of the busbar through a slot in the clamping section and/or in the actuating section, and in that that section of the bearing arm which extends through the slot is arranged in a region between the side edges of the clamping spring, and the actuating element is mounted displaceably pivotably or linearly on the bearing arm.

2. The spring force terminal connection as claimed in claim 1, wherein the bearing arm is arranged centrally in the direction of the width of the clamping spring.

3. The spring force terminal connection as claimed in claim 1, wherein the bearing arm is formed integrally with the clamping spring as an extension of the resting section and is bent back in the direction of the actuating section.

4. The spring force terminal connection as claimed in claim 1, wherein the bearing arm is mounted between the resting section of the clamping spring and the busbar.

5. The spring force terminal connection as claimed in claim 1, wherein the bearing arm has a pivot bearing at its end remote from the busbar, and in that the actuating element is mounted pivotably in the pivot bearing.

6. The spring force terminal connection as claimed in claim 1, wherein the bearing arm is fixed on the busbar, and the actuating element is arranged linearly movably relative to the busbar on the bearing arm.

7. An electrical device comprising an insulating housing and comprising at least one spring force terminal connection as claimed in claim 1 in the insulating housing.

* * * * *